US006330889B1

(12) United States Patent
Overton

(10) Patent No.: US 6,330,889 B1
(45) Date of Patent: Dec. 18, 2001

(54) FACE SHADE

(76) Inventor: Kym J. Overton, 111 E. 14th St., Apt. 369, New York, NY (US) 10003-4103

( * ) Notice: Subject to any disclaimer, the term of this patent is extended or adjusted under 35 U.S.C. 154(b) by 0 days.

(21) Appl. No.: 09/511,260

(22) Filed: Feb. 23, 2000

(51) Int. Cl.[7] ..... E04H 15/30

(52) U.S. Cl. ..... 135/95; 135/87; 135/115; 135/117; 135/124; 135/128; 135/143

(58) Field of Search ..... 135/902, 904, 135/907, 121, 128, 95, 87, 124, 143, 115, 117

(56) References Cited

U.S. PATENT DOCUMENTS 3,255,467 * 6/1966 Kowalski ..... 135/902
4,063,318 * 12/1977 Nicholson ..... 135/902
4,180,112 * 12/1979 Bovet ..... 135/902
4,343,322 * 8/1982 Fiddler ..... 135/902
4,606,070 * 8/1986 Schachter ..... 135/95
4,681,195 * 7/1987 Trahan ..... 135/95
4,796,734 * 1/1989 Distasio ..... 135/95
4,881,565 * 11/1989 Turk ..... 135/101
4,966,181 * 10/1990 Liberman ..... 135/87
5,059,463 * 10/1991 Peters ..... 135/95
5,752,537 * 5/1998 Kranzler ..... 135/128
5,941,265 * 8/1999 Zheng ..... 135/125
6,170,504 * 1/2001 Tsai ..... 135/121

* cited by examiner

*Primary Examiner*—Beth A. Stephan
(74) *Attorney, Agent, or Firm*—Pharmaceutical Patent Attorneys, LLP; Mark Pohl

(57) ABSTRACT

A compact shade for the face of a sunbather or someone lying in the sun. The shade allows the circulation of air to flow about the sunbathers face, neck and head while tanning the rest of their body. The shade folds and can be used as a carrying case for personal goods.

5 Claims, 6 Drawing Sheets

FIGURE I.
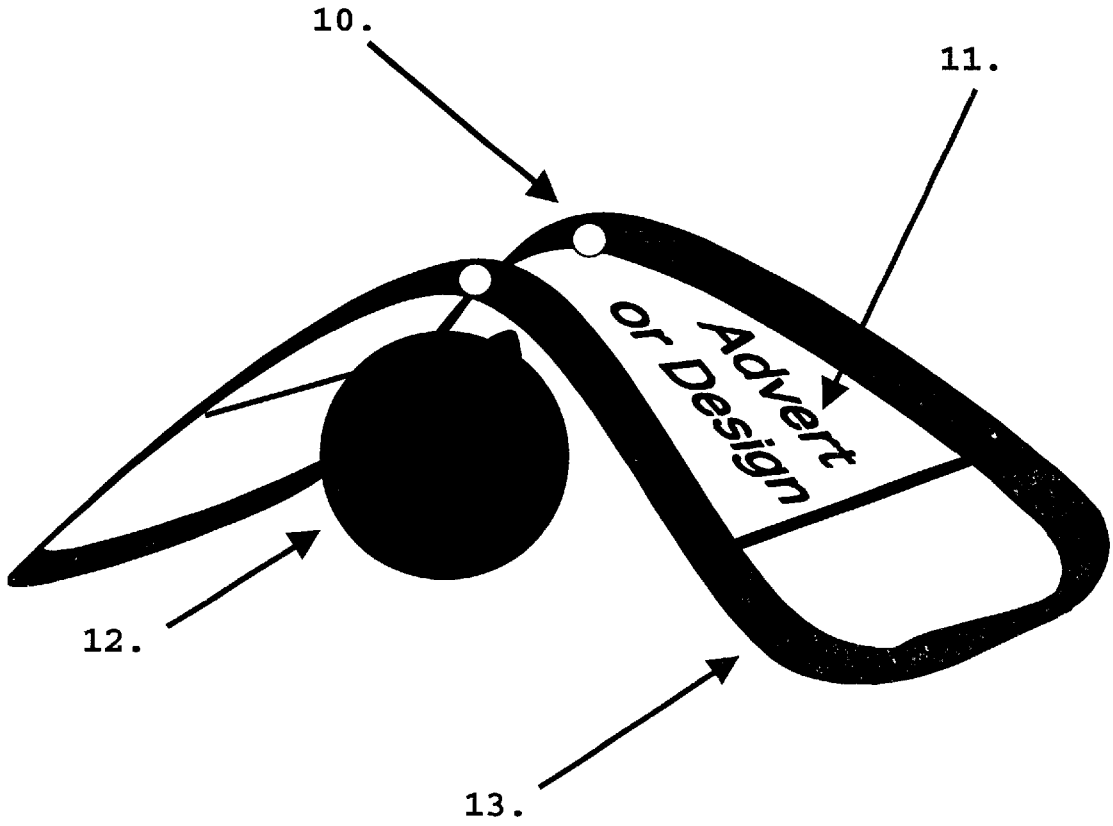

FIGURE II.
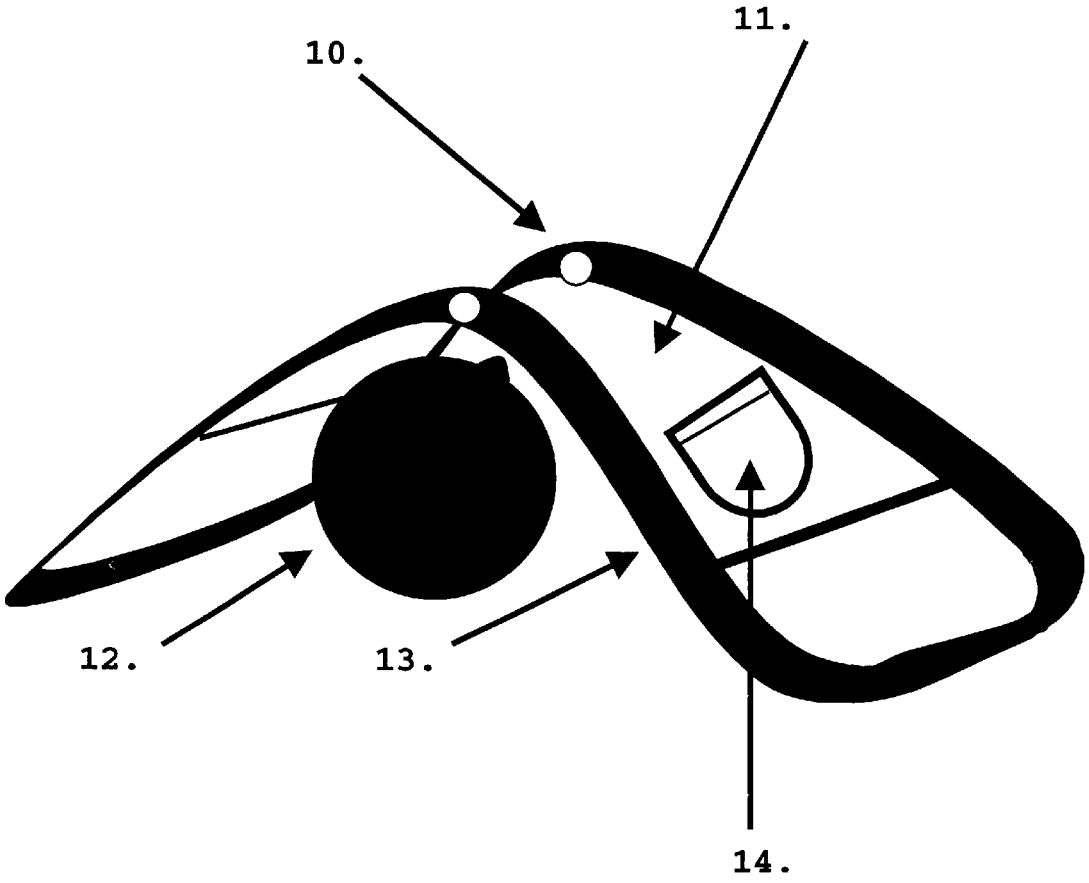

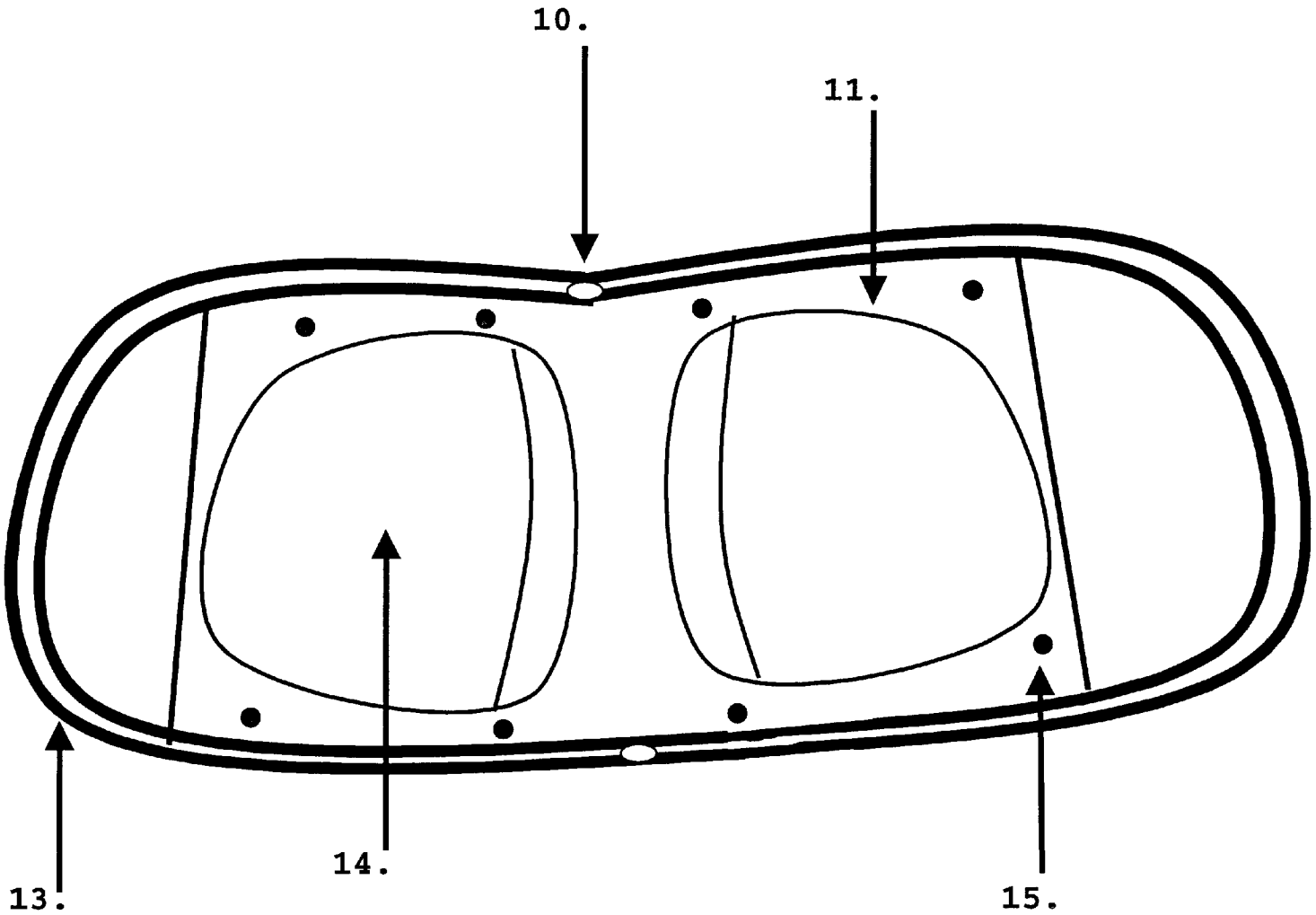
FIGURE III.

FIGURE IV.
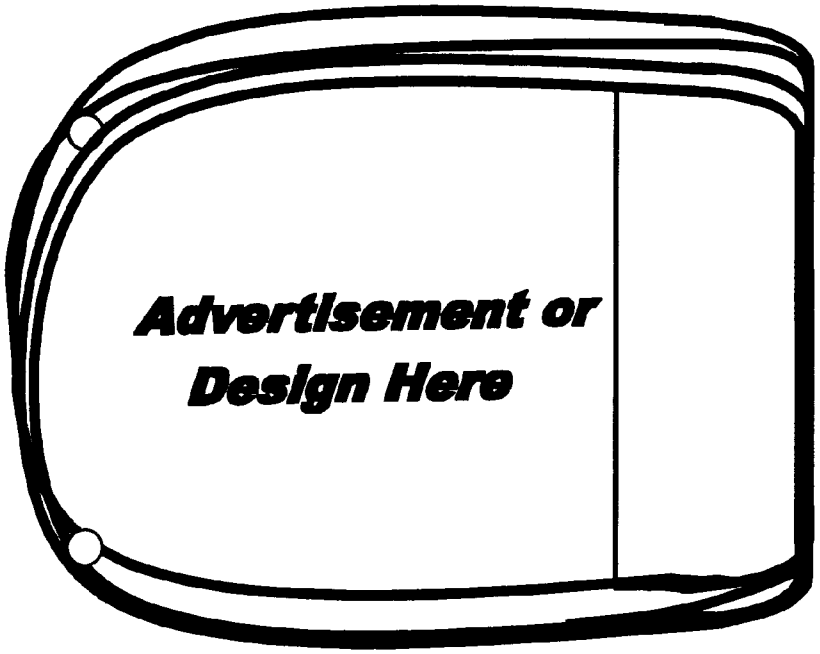

FIGURE V.
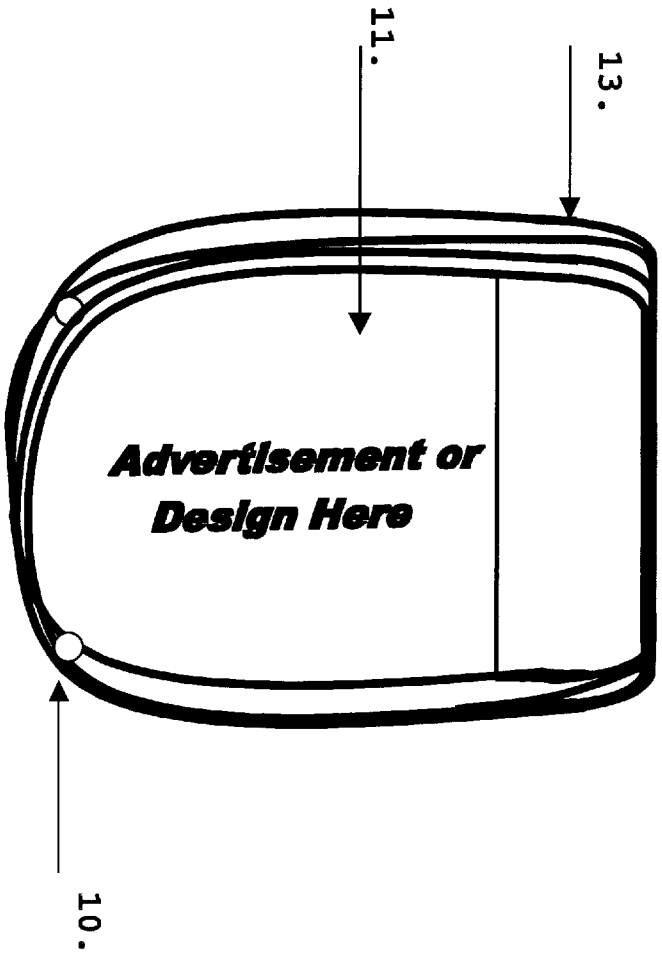

FIGURE VI.
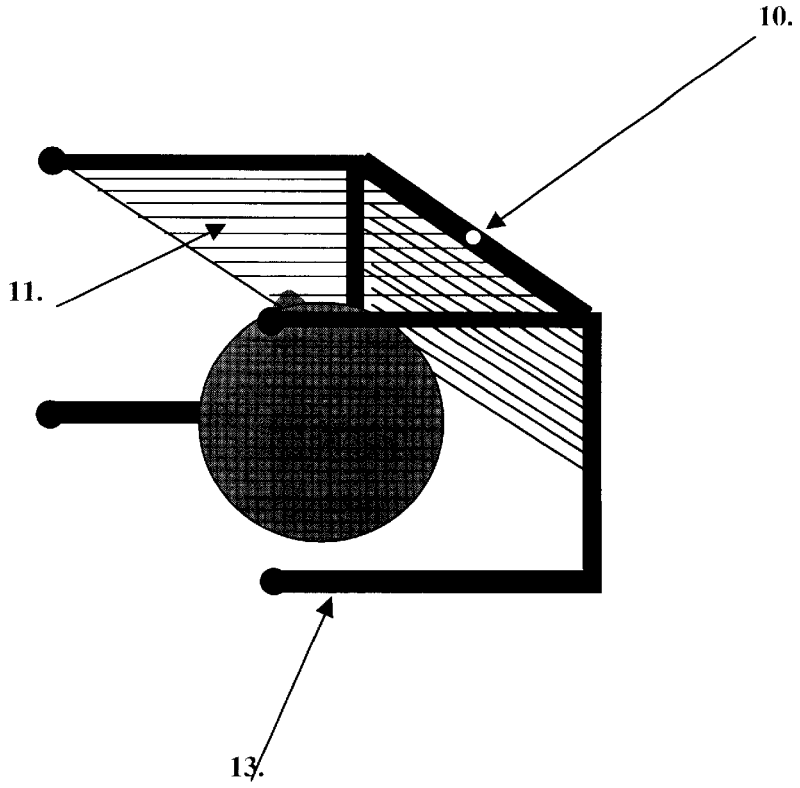

FACE SHADE

BACKGROUND

The invention is a compact shade that blocks the face of someone sunbathing or lying in the sun, from the sun while allowing the circulation of air to flow naturally on and around that persons face and head while laying out tanning the rest of their body. The shade is made from protective material to assist with keeping the skin healthy and protected from the sun's rays and its many harmful effects that occur when the face is over exposed to the sun. More specifically, the invention is a compact shade for the face of sunbather or someone lying in the sun using UV protective material to provide maximum protection from the sun's rays while tanning, or allowing sun to, the rest of their body with the natural circulation of air reaching their face and head.

This invention was created to protect a sunbather's face from the suns harmful rays, providing maximum protection for the face from the sun while tanning the rest of the body. More people are becoming conscious of the damage that the sun can do to ones face and are taking various precautions to protect themselves from the fatal and/or irreversible damages such as; premature aging, sun spots, create permanent scars from blemishes, skin cancer, heat stroke, sun poison and 2 $^{nd}$ degree burns. The shade is for the sunbathers who enjoy lying in the sun, but want maximum protection from the sun for their face for reasons mentioned or not mentioned above, while getting the circulation of air to the face and head that creates the most comfort while sunbathing.

Precautions made by sunbathers protecting their face from the sun while lying out are to place a piece of clothing, a hat, cloth or some sort of fabric/material directly on one's face, which in turn can cause a level of discomfort by not allowing the natural circulation of air. Therefore, the sunbather becomes hot, uncomfortable and may begin to sweat. Another common form of protection from the sun is sunscreen. Sunscreens are not 100% effective and are often heavy and may cause discomfort and/or skin irritations when applied to the face. Using the Face Shade will ensure maximum protection from the sun for the face in the most comfortable way allowing the circulation of air to flow naturally around the sunbathers face and head creating a more comfortable sunbathing experience.

SUMMARY

The objective of this invention is to give sunbathers a way to obtain maximum protection against the sun in the most comfortable way. The device is easy to tote and may conveniently carry a limited amount of personal belongings. The face canopy's weight, size, shape and compactability make it easy to tote to and from their sunny destination with ease, comfort and convenience.

BRIEF DESCRIPTION OF THE DRAWINGS

FIG. I shows the shade at an angle, with the top of a head of a sunbather (12), the hinge(s) (10) that holds together the 2 U-shaped components (13) of the shade frame, and the shade material (11) covering the frame.

FIG. II shows the shade at an angle, including an optional pocket (14).

FIG. III shows a view of the shade as it appears fully opened and flattened, with the hinge (10), the 2 U-shaped components (13) of the shade frame, the shade material (11), pockets (14) and fasteners (15) that hold the material (11) to the frame (13).

FIG. IV. shows a side view of the face shade in its closed position.

FIG. V shows an end view of a version of the face shade in its closed position, illustrating how the frame can be constructed of bend able or bent material, such that the bases of the frame (13) can be folded together to make an enclosed space between the shade material (11) for carrying things.

DETAILED DESCRIPTION

The face shade/shade's structure consists of two U-shaped components that are slightly arched creating a bridge structure (FIGS. I & II) over the sunbather's face. The U-shaped frame components (13) are attached at the ends by a hinge (10) that allows the face shade to fold in half. The two U-shaped components (13) are covered with UV protective material (11), creating a shade of shade over the face of the sunbather, providing protection from the sun and allowing the natural circulation of air to flow while tanning the rest of their body.

The protective material (11) can be detachable from the frame (13). Attachments can be, for example, snaps (14), buttons, VELCRO (TM), string ties or the like. The protective material (11) can be designed with a multiple of patterns and/or used for advertisers, marketers, and/or sponsors.

The base of the frame (13) can be used as carrying handle when the frame is folded closed. The shade, when in its carrying position (closed and held upright), can also be used to store personal belongings as would a tote bag or a purse. Optionally, the shade can include pockets on the inside of the shade device and may seal in the pocketed items with but not limited to snaps, buttons, Velcro and/or string ties.

When folded and held upright, part of the frame (13) not covered by material (11) can be used as handles. In addition, the face shade can be used to carry a limited number of items when closed and in its upright and carrying position, perhaps with pockets (14) that are optional. The pockets (14) can be on the inside or the outside of the canopy's UV/sun protective material (11).

The height of the face shade, when open and in use, stands just above the average height of a head to promote a natural circulation of air on and around the face and head of the sunbather creating a comfortable sunbathing experience while keeping their face in the shade. The shade can be made in different sizes, to suit children, babies or pets.

The material that surrounds the device's frame, creating the shade, is UV/sun proof/protective material giving the user protection from the sun for their face while sunbathing the rest of their body; the sides of the frame at the base (13) can, in one version, be not covered completely by the material (11), to allow for the air to circulate as much as possible, and to create carrying handles (13).

My invention can also be made with detachable pockets for the face shade. Pockets can be attached to the device to hold the personal belongings of the user, (sunglasses, portable radio device, suntan oil, and beverages) while the device is open and in use.

Another version of my invention can incorporate wiring for portable music devices to plug directly into the shade, with attachable speakers that play within the "arc" of the shade and give the sunbather a personal stereo experience.

The frame is made of two U-Shaped components that are attached together by hinges at the U's tips. The two U-Shaped components are made of but not limited to aluminum, plastic, wood/bamboo, or wire. The two U-Shaped components slightly arched creating a bridge over the sunbathers face when attached together. This arc, the U-shapes attached at the tips, creates the frame of the shade and are covered by the protective material by about ⅔ each side. The frame is built to stand just above the average height of someone's head, when open and in use, to promote the natural circulation of air for the user.

Although I have described my invention in considerable detail with reference to certain versions, other versions are possible. For example, versions can be made bearing, or lacking, advertising on the protective material (11). Therefore, the spirit and scope of the appended claims should not be limited to only the description of my preferred versions contained in the foregoing discussion. The features in this specification, and the accompanying drawings, claims and abstract, may be replaced by alternative features serving the same or similar purpose.

I claim:

1. A foldable face shade for a sunbather comprising:

a. a first U-shaped frame component, b. a second U-shaped frame component, c. a hinge movably connecting the tips of said first U-shaped frame component to the tips of said second U-shaped frame component, whereby said two U-shaped frame components form a frame foldable in half, and d. UV deflecting material attached to said frame.

2. The apparatus of claim 1, further comprising a pocket attached to said UV deflecting material.

3. The apparatus of claim 1, wherein said UV deflecting material does not entirely cover said frame, whereby an exposed portion of said frame can be used as a carrying handle.

4. The apparatus of claim 1, wherein said UV deflecting material can be used to carry personal belongings when said frame is folded about said hinge.

5. The apparatus of claim 1, further comprising sponsor advertising displayed on said UV deflecting material.

* * * * *